US010260799B2

(12) United States Patent
Becke et al.

(10) Patent No.: US 10,260,799 B2
(45) Date of Patent: Apr. 16, 2019

(54) DOMESTIC REFRIGERATION DEVICE HAVING A CONTROL ELEMENT DESIGNED WITH AN INTEGRATED DISPLAY UNIT FOR ACTUATING A COVER OF A FOOD STORAGE CONTAINER

(71) Applicant: BSH HAUSGERAETE GMBH, Munich (DE)

(72) Inventors: Christoph Becke, Grosskarolinenfeld (DE); Max Eicher, Munich (DE); Juergen Fink, Gerstetten (DE); Christine Hartwein, Nandlstadt (DE); Denis Lux, Heidenheim (DE); Thomas Tischer, Haar (DE); Marcus Wehlauch, Nattheim (DE)

(73) Assignee: BSH Hausgeraete GmbH, Munich (DE)

( * ) Notice: Subject to any disclaimer, the term of this patent is extended or adjusted under 35 U.S.C. 154(b) by 57 days.

(21) Appl. No.: 15/510,749

(22) PCT Filed: Aug. 27, 2015

(86) PCT No.: PCT/EP2015/069607
§ 371 (c)(1),
(2) Date: Mar. 13, 2017

(87) PCT Pub. No.: WO2016/037860
PCT Pub. Date: Mar. 17, 2016

(65) Prior Publication Data

US 2017/0254587 A1 Sep. 7, 2017

(30) Foreign Application Priority Data

Sep. 12, 2014 (DE) ..... 10 2014 218 274

(51) Int. Cl.
*F25D 25/02* (2006.01)
*F25D 17/04* (2006.01)
(Continued)

(52) U.S. Cl.
CPC ..... *F25D 25/025* (2013.01); *F25D 29/005* (2013.01); *F25D 2317/04131* (2013.01); *F25D 2400/36* (2013.01)

(58) Field of Classification Search
CPC ..... F25D 25/025; F25D 25/021; F25D 23/026
See application file for complete search history.

(56) References Cited

U.S. PATENT DOCUMENTS 2,129,474 A * 9/1938 Money ..... F25D 29/00 116/307
2,450,823 A * 10/1948 Bauman ..... F25D 29/00 200/36
(Continued)

FOREIGN PATENT DOCUMENTS

CN 1615096 A 5/2005
CN 102667374 A 9/2012
(Continued)

*Primary Examiner* — Kimberley S Wright
(74) *Attorney, Agent, or Firm* — Laurence A. Greenberg; Werner H. Stemer; Ralph E. Locher

(57) ABSTRACT

A domestic refrigeration device has an internal space for receiving foodstuffs, which is bounded by walls of an internal container, and a storage container for foodstuffs that is arranged in the internal space and can be closed with a lid. The refrigerator further has a mounting device with which the lid is mounted in the internal space such that it can be raised and lowered for opening and closing the food storage container. A control element is provided by which the lid can be actuated, wherein the control element for actuating the lid can be actuated along an actuation path and the lid can be positioned, in dependence on a position of the control element, in a first closed position and at least in a second
(Continued)

fully open position. The control element itself has a display unit for displaying symbolic information depending on the position of the lid.

15 Claims, 9 Drawing Sheets

(51) Int. Cl.
*F25D 23/02* (2006.01)
*F25D 29/00* (2006.01)

(56) References Cited

U.S. PATENT DOCUMENTS 3,364,694 A * 1/1968 Cohen ..... F25D 17/065 62/265
4,850,206 A * 7/1989 Larsen ..... F25D 17/04 62/382
7,624,593 B2 * 12/2009 Lee ..... F25D 17/045 62/408
8,135,482 B2 3/2012 Caldwell et al.
9,453,672 B2 * 9/2016 Becke ..... F25D 25/025
9,677,806 B2 * 6/2017 Bischofberger ..... F25D 25/025
9,903,635 B2 * 2/2018 Eicher ..... F25D 17/042
2003/0090890 A1 5/2003 Miozza et al.
2003/0222044 A1 * 12/2003 Maritan ..... F25D 25/02 211/153
2005/0172657 A1 * 8/2005 Hwang ..... F25D 25/025 62/407
2007/0097042 A1 * 5/2007 Bauer ..... F25D 29/00 345/82
2007/0104841 A1 * 5/2007 Min ..... A23L 3/005 426/248
2007/0151836 A1 * 7/2007 Oh ..... F25D 29/00 200/314
2009/0033188 A1 * 2/2009 Becke ..... F25D 25/02 312/404
2010/0251754 A1 * 10/2010 Lim ..... F25D 17/042 62/455
2011/0146334 A1 * 6/2011 Kim ..... F25D 17/042 62/441
2011/0259036 A1 * 10/2011 Lim ..... F25C 1/24 62/344
2012/0099255 A1 * 4/2012 Lee ..... F25D 25/025 361/679.01
2012/0146477 A1 * 6/2012 Bischofberger ..... F25D 25/025 312/404
2015/0300724 A1 * 10/2015 Becke ..... F25D 25/025 312/405
2017/0131016 A1 * 5/2017 Eicher ..... F25D 17/042

FOREIGN PATENT DOCUMENTS

DE 4040341 C2 5/1994
DE 102012221497 A1 5/2014
DE 102012221499 A1 5/2014
WO 2011026749 A2 3/2011

* cited by examiner

DOMESTIC REFRIGERATION DEVICE HAVING A CONTROL ELEMENT DESIGNED WITH AN INTEGRATED DISPLAY UNIT FOR ACTUATING A COVER OF A FOOD STORAGE CONTAINER

BACKGROUND OF THE INVENTION

Field of the Invention

The invention relates to a domestic refrigeration appliance with an internal compartment, which is designed to hold food. The internal compartment is bounded by walls of an internal container. The domestic refrigeration appliance also comprises a food storage container, which is arranged in the internal compartment. The food storage container can be closed by a lid. A mounting device is also designed to mount the lid in the internal compartment in such a manner that it can be raised and lowered to open and close the food storage container. The lid can be actuated by means of an operating element.

Such configurations are known from the prior art. WO 2011/026749 A2 shows a corresponding refrigeration appliance with a vegetable drawer. A tray for holding the vegetables can be introduced into the internal compartment and removed therefrom. Said tray can be covered at the top by a cover. The cover rests on angled upper edges of the tray in the closed state. A further plate is arranged above the cover with a front strip configured thereon, on which an operating element is positioned in a movable manner. The operating element can be displaced parallel to the front strip and to this end is coupled to an angled guide path in the form of a slot configured in the cover. The cover is then raised as a function of such displacement of said slider, the cover being connected to the plate arranged above it by way of a corresponding mechanical coupling.

A food storage box with a closeable lid is also known from DE 40 40 341 C2. This box can also be introduced into an internal compartment of a domestic refrigeration appliance.

In the two embodiments known from the prior art provision is made for the chilled goods introduced therein, for example in the form of vegetables, salad, meat, fruit and the like, to be protected against drying out quickly in an undesirable manner. The problems occurring in this context are already set out at length in DE 40 40 341 C2. There is no provision for conveying information adequately to the user about the state of the food storage container.

SUMMARY OF THE INVENTION

It is the object of the present invention to create a domestic refrigeration appliance, with which information about the food storage container can be presented to the user in an improved manner.

This object is achieved by a domestic refrigeration appliance having the features of the main claim.

An inventive domestic refrigeration appliance comprises an internal compartment for holding food, which is bounded by walls of an internal container. The domestic refrigeration appliance also comprises a food storage container for holding food, which is arranged in the internal compartment and can be closed by a lid. The domestic refrigeration appliance also comprises a mounting device, which mounts the lid in the internal compartment in such a manner that it can be raised and lowered to open and close the food storage container. The domestic refrigeration appliance also has an operating element which can be used to actuate the lid. To actuate the lid, the operating element can be actuated on an actuation path and the lid can be positioned in a first closed position and at least in a second completely open position as a function of a position of the operating element. One important concept of the invention should be seen as being that the operating element itself has a display unit. The display unit is designed to display symbolic information as a function of the position of the lid. The invention therefore in principle allows extensive information about the state of the food storage container or at least a sub-element to be conveyed to the user, which also means that the information display either conveys this operating state of the component of the food storage container directly or a state in the food storage container associated with the position of said component is displayed as information. This configuration allows the user to be presented with information in a manner that is easy to understand, said information relating for example to the moisture content in the food storage container and/or a food that can preferably be stored in a food storage container in the respective state or with the component of the food storage container in the respective position. Of particular importance in the invention is the position of the location of the display unit on the operating element itself. It allows the user to identify, almost during actuation of the operating element, without delay and in the same viewing direction, the information that is then displayed. The invention also allows a compact structure to be achieved, in addition to the advantage of the configuration of the location of the operating element and display unit.

Provision is preferably made for the display unit to be a non-electronic display unit. This is advantageous in that there is no need for extensive cabling or the provision of electrical components and the display unit therefore remains operationally reliable and permanently serviceable. Ambient conditions mean that such a non-electronic display unit is robust and provides long-term functionality in precisely such an area of use in the internal compartment or receiving compartment of the domestic refrigeration appliance.

Provision is preferably made for the display unit to have an information disk, which comprises information elements configured in a fixed position and permanently thereon. This specific geometry of the information disk, which should be understood as being in the manner of a flat cylinder, does not affect the configuration of the operating element for ease of use for a user and also allows very compact accommodation in the operating element.

Provision is preferably made for the information elements to be configured as printing on the information disk. This allows them to be produced simply and economically and to be applied with positional stability. Printing also allows the configuration to be wear-resistant and in particular abrasion resistant.

Provision is preferably made for the information disk to be arranged in the operating element and to be fastened in a fixed position on an operating element support, on which the operating element is arranged in such a manner that it can be moved relative thereto. This is a particularly advantageous embodiment in that although the information disk is accommodated in the operating element itself, it is arranged and coupled mechanically in such a manner that it remains in a fixed position relative to the operating element support when the operating element moves and therefore the operating element itself can as it were move relative to the information disk even though it accommodates said information disk. This allows the very precise and clear display of information elements.

Provision is preferably made for the information disk to be fastened, in particular latched, to the operating element support in a non-destructively releasable manner.

Latching in this context is a simple mechanical connection which is still functionally reliable and stable so that corresponding forces that result can be absorbed without damage occurring. Latching is also relatively simple to release so taking apart and putting back together again can be achieved very easily for assembly or cleaning purposes or to replace a component.

Provision is preferably made for the display unit to have a cover plate arranged in the operating element, covering an information disk of the display unit from above. This protects the information disk, which comprises or holds in particular applied symbolic information elements, so that it is not exposed and cannot be scratched or otherwise damaged.

Provision is preferably made for the cover plate to be arranged in a fixed position on the operating element in such a manner that it can be moved relative to the information disk. This embodiment makes the cover plate as it were an outer component of the display unit, which also then represents an outer component of the operating element, and thus forms as it were an outer casing for the information disk. Because the cover plate is coupled to the operating element in a fixed position, even if the operating element moves, it does not produce unwanted play or relative movement between the operating element and the cover plate. This in turn produces a high-quality component part which also allows very precise relative movement between the operating element and therefore also the cover plate and the information disk, allowing very accurate position setting between the cited parts. This is particularly advantageous in order to achieve a very precise display of the respectively assigned information element as a function of the position of the lid, even when there are a number of information elements applied to the information disk, and thus also to be able to convey an extremely precise information display to the user without a user being unsure about reading it correctly.

The cover plate is preferably connected to the operating element by means of a non-destructively releasable connection, it being possible for latching in particular to be provided here. The abovementioned advantages apply here again in the same manner.

Provision is preferably made for the cover plate to have at least one viewing window, through which an information element configured on an upper face of the information disk facing the cover plate can be identified as a function of the position of the operating element and therefore the position of the cover plate relative to the information disk. Therefore only the information element associated with the respective operating state of the food storage container can be seen through the viewing window in each instance when viewing the operating element and therefore also the display unit from above. This also means therefore that only the symbolic information element associated with a specific position of the lid and an associated moisture content in the food storage container and/or an associated preferred storage of a specific food in the food storage container can be identified through the viewing window. This allows a simple and clear display of information that cannot be misinterpreted as this one information element can be identified.

Provision is preferably made for the cover plate to be configured from an at least translucent material and to be provided, in particular printed, with an opaque material on a lower face facing the information disk, apart from the viewing window. This further favors the abovementioned advantages and allows very exact definition of the size and demarcation of a viewing window.

Such application of a material also allows a certain resistant strength to be achieved and therefore also protection against scratching. The translucent material of the cover plate therefore also remains permanently unimpaired and even in the event of relative friction during mutual contact between the cover plate and the information disk this additional material on the lower face of the cover plate increases resistant strength.

Provision can be made for this applied material also to be selected with regard to slipperiness, so that when the cover plate is in contact with the information disk, relative movement is effortlessly achieved between them. This allows a wide range of materials to be used, with a high degree of slipperiness and therefore a low level of surface roughness.

Provision is preferably made for the operating element to have a mushroom-shaped display unit support for the display unit, the display unit support being arranged on an operating element support so that it can be moved relative thereto. An information disk and a cover plate of the display unit are arranged and accommodated in a mushroom-shaped head of the display unit support. Such geometric embodiments allow the operating element itself to be dimensioned correspondingly and designed so that it can be grasped in a user-friendly manner at those points, specifically the mushroom-shaped head, where a user grips it, to actuate it. This mushroom-shaped configuration of the display unit support also allows it to be configured in a relatively delicate manner to produce an operating element with greatly minimized weight, which can be rotated easily and effortlessly. This configuration also allows easier coupling of the operating element to a coupling facility to actuate the lid. In particular however this configuration and the mushroom-shaped head allow a relatively large sub-element to be produced, on which a relatively large information disk can then also be arranged in order to be able to display on the one hand extensive, on the other hand also adequately sized information elements so that these can then also be perceived in a comprehensible and clear manner by a user.

Provision is preferably made for the operating element to have a terminating ring, which is connected in a rotationally fixed manner to the display unit support and which encloses the mushroom-shaped head and cover plate peripherally. This configuration provides a terminating element in the circumferential direction so that the sides of the information disk and cover element are not exposed. On the one hand this means that the information disk is as it were completely encapsulated, as it is enclosed from above by the cover plate and from below by the base of the mushroom-shaped head of the display unit support, as well as also being covered at its periphery by said terminating ring. This allows the information disk to be positioned without restriction with little wear and no dust or other dirt can reach the information disk and/or between the information disk and the cover plate. This allows effortless relative movement between the components and the display unit and the operating element relative to the information disk in a permanent manner.

Provision is preferably made for the terminating ring to have a cone-shaped upper face or outer face facing away from the operating element support.

Provision is preferably made for a stem of the display unit support to extend through an opening in the operating element support and to be connected, in particular latched, to a coupling device to move the lid.

Provision is preferably made for the information element to symbolize a specific moisture content in the food storage container. Provision can also be made for information elements to represent by symbols and/or letters those foods which are most suitable for storage at the time, given the respective state of the food storage container, in particular the position of the lid. The information elements can also be characterized by specific color symbols.

Provision is made in particular for the food storage container to have a drawer in addition to the lid, it being possible for said drawer to be covered from above by the lid.

The operating element is preferably a rotary actuator so that the actuation path of the operating element is a rotation movement.

In a further advantageous embodiment provision is made for an operating element support to have a platform on which information about the moisture content in the food storage container as a function of the position of the lid is displayed in a fixed position. With this embodiment a display of information elements is also configured on the display unit of the operating element, these being information about the food preferably to be stored in the food storage container with the lid in the respective position. This configuration allows a variety of different information to be displayed to a user in a positionally very focused manner in almost every position of the lid, providing specific information relating to the moisture content and food. This positional separation also maintains clarity.

Provision is preferably made for a wall that rises obliquely to the rear and upward and therefore away from the operating element or a surface region to be configured, on which the information about the moisture content is displayed. The information about the moisture content here is preferably also displayed as information in a permanently fixed position that cannot be modified, for example by printing.

The operating element support is also configured with a base plate, on which the operating element is arranged or rests and on which the platform is then configured. Discernible connecting elements, in particular lines, are then also marked in particular on this base plate so that the assigned moisture content can be identified immediately on the surface region in every rotation position of the operating element and with the associated display of an information characterizing the food on the display unit of the operating element.

Further features of the invention will emerge from the claims, the figures and the description of the figures. All the features and feature combinations cited above in the description as well as the features and feature combinations cited in the following in the description of the figures and/or only shown in the figures can be used not only in the combination indicated in each instance but also in other combinations or alone, without departing from the scope of the invention. Embodiments of the invention which are not shown and described specifically in the figures but emerge and can be produced by means of separate feature combinations from the described embodiments should therefore also be deemed to be covered and disclosed.

BRIEF DESCRIPTION OF THE SEVERAL VIEWS OF THE DRAWING

Exemplary embodiments of the invention are described in more detail below with reference to schematic drawings, in which.

DESCRIPTION OF THE INVENTION

Figure 1:
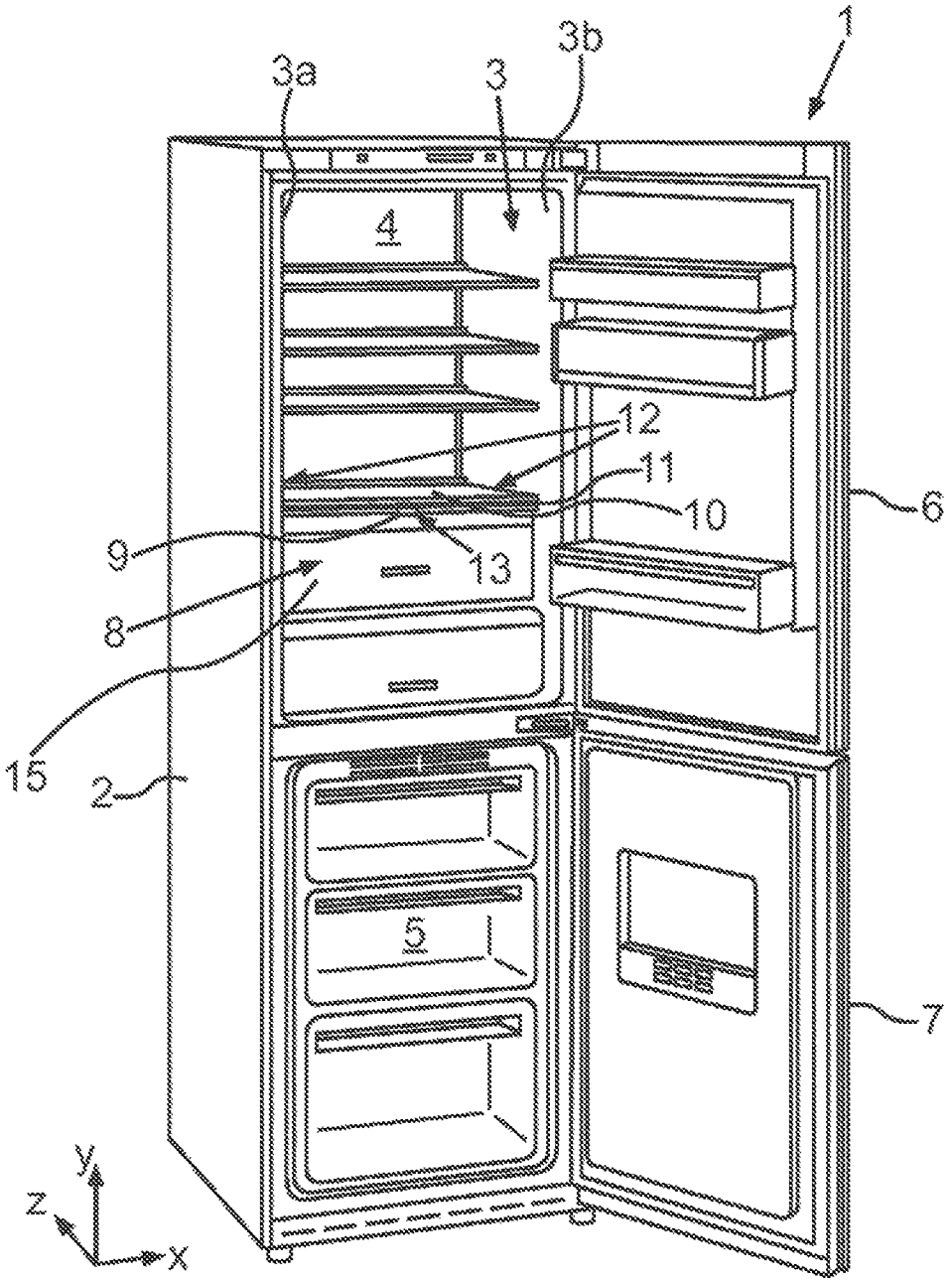
FIG. 1 shows a perspective view of an exemplary embodiment of an inventive domestic refrigeration appliance.

Identical elements or those of identical function are shown with identical reference characters in the figures.

FIG. 1 shows an exemplary view of a domestic refrigeration appliance 1, which is configured as a combined refrigerator/freezer appliance. The domestic refrigeration appliance 1 comprises a carcass 2 with an internal container 3. The walls of the internal container 3 bound a first internal compartment, which is a chiller compartment 4, and a separate second internal compartment arranged below, which is a freezer compartment 5. The chiller compartment 4 generally serves to chill chilled goods in a frost-free manner, preferably at temperatures between +4° C. and +8° C. The chiller compartment 4 can however also be configured as a zero degree compartment, in particular for storing fruit or vegetables. The chiller compartment 4 can be accessed when the door 6, which closes the compartment 4 at the front, is open.

The freezer compartment 5 generally serves to deep-freeze frozen goods, at −18° C. for example. The freezer compartment 5 is accessible when the freezer compartment door 7 is open.

Mounted in a removable manner in the chiller compartment 4 is a chilled goods or food storage container 8, which can be closed by means of a lid 9 mounted above the food storage compartment 8. An additional cover 10, for example in the form of a glass compartment base, can be arranged above the lid 9, as shown.

The internal container 3 has two opposing vertical side walls 3*a* and 3*b*.

Provision is preferably made for a separating wall 11 to be arranged between the lid 9 and the cover 10. This separates the food storage container 8 from the remaining sub-volume of the internal compartment or chiller compartment 4.

The lid 9 is mounted in the chiller compartment 4 by means of a mounting device 12 in such a manner that it can be raised and lowered to open and close the food storage container 8. In particular the mounting device 12 comprises an operating element 13, which can be used to actuate the lid 9. To actuate the lid 9, the operating element 13 can be rotated about an axis on an actuation path and can be latched at least in one rotation position along the actuation path.

The operating element 13 is arranged on the separating wall 11.

The separating wall 11, which is arranged above the lid 9 in the vertical direction and therefore in the y direction, is configured in such a manner in the illustrated exemplary embodiment that it also serves as a support plate for the lid 9. In this exemplary embodiment the lid 9 is therefore mounted solely on said separating wall 11 and can be displaced relative to said separating wall 11 in order then to be raised or lowered in relation to a tray or drawer 15 of the food storage container 8, in order to be able to set the opened or closed state of the food storage container 8.

The food storage container 8 comprises the lid 9 and the drawer 15.

Figure 2:
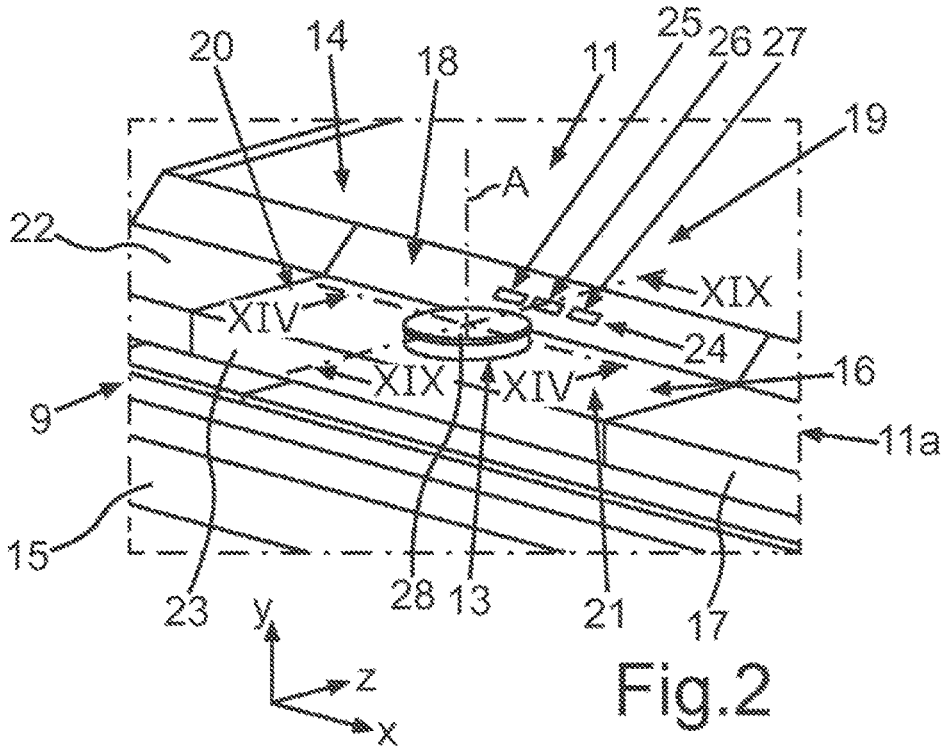
FIG. 2 shows a perspective view of a partial detail of the domestic refrigeration appliance in a front region of a separating wall above a lid of a food storage container.

The horizontal separating plate or the separating wall 11, as shown in FIG. 2, comprises an operating element support 11*a*, which has for example a base body or a base part 14 and a separate plate-type element in the form of a facing 20, which can be attached to the base part 14 in a non-destructively releasable manner. However the facing 20 may also not be present. The operating element support 11*a* also has a horizontally oriented platform 16 on the base part 14*a*, the operating element 13 resting or being arranged thereon.

The base part 14 comprises a front edge 17 and a surface region 18, which is offset to the rear in the depthwise direction (z direction) in relation to the front edge 17 and oriented obliquely upward and to the rear. This forms an oblique step. This angled surface region 18 is configured practically in the manner of a strip and extends in particular over the entire width of the base part 14 and is configured on an upper face 19 facing away from the lid 9. The facing 20 is arranged in an embedded manner in said base part 14 so that an upper face 21 of the facing 20 is arranged flush with an upper face 22, which represents a sub-region of the upper face 19. The facing 20 is therefore arranged flush in the base part 14 in the region of the platform 16, which is offset downward in the vertical direction at the front.

A front face 23 of the facing 20 forms a piece of the front edge 17.

A display region 24 is also configured on the base part 14 in the surface region 18, in particular in the facing 20, allowing a symbolic or approximate representation of a display of a moisture content in the food storage container 8 to be displayed. To this end in this exemplary embodiment elements are configured on the region of the facing 20 which is oriented obliquely upward and to the rear through the surface region 18. In the exemplary embodiment three different elements or objects 25, 26 and 27 are shown, which are associated with three different specific positions of the lid 9 relative to the drawer 15. These also symbolically characterize moisture contents in the food storage container 8 specifying respective lid positions and associated therewith. The objects 25 to 27 can be printed on.

Also shown is the operating element 13, which is positioned between the front edge 17 and the surface region 18 when viewed in the depthwise direction and is therefore accessible from above. Actuation of the operating element 13 causes the lid 9 to be moved by way of an in particular solely mechanical interaction and coupling. The lid 9 can also be mounted on the mounting device 12, which is configured solely on the walls 3*a* and 3*b*. Its position can be changed for this purpose in a raising and pushing movement. To this end corresponding mounting elements of the mounting device 12 can be arranged so that they are oriented obliquely to the rear and upward on the walls 3*a* and 3*b*.

When the lid 9 is moved relative to the drawer 15, the moisture content in the food storage container 8 also changes. An observer can then identify the information about the symbolically displayed moisture content intuitively and in an immediately comprehensible manner.

In one configuration a specific position of the lid 9 is associated with a rotation position of the operating element 13 about the axis A, which extends in the vertical direction and therefore in the y direction.

As also shown in FIG. 2, the operating element 13 itself also comprises a display unit 28. The display unit 28 is configured to display symbolic information as a function of the position of the lid 9. The display unit 28 is a non-electronic display unit. Non-modifiable information elements that are applied in a fixed position and permanent manner are preferably present for this information display. Said information elements are in particular configured as printing.

Provision can also be made, irrespective of the embodiment described above in FIG. 2, for the objects 25 to 27 not to be present and for only the display unit 28 to be configured on or in the operating element 13.

The information elements of the display unit 28 can comprise symbols and/or letters. They can symbolize the moisture content in the food storage container 8, particularly when the objects 25 to 27 are not present. However they can also or instead symbolize foods which can be preferably and most appropriately stored in the food storage container 8 in the respective states associated with the different positions of the lid 9.

In particular when the objects 25 to 27 are present and symbolize the moisture content, information elements on the display unit 28 can preferably be information elements which represent food that can preferably be stored in the food storage container 8 and therefore also in the drawer 15 with the lid 9 in the respective position.

Figure 3:
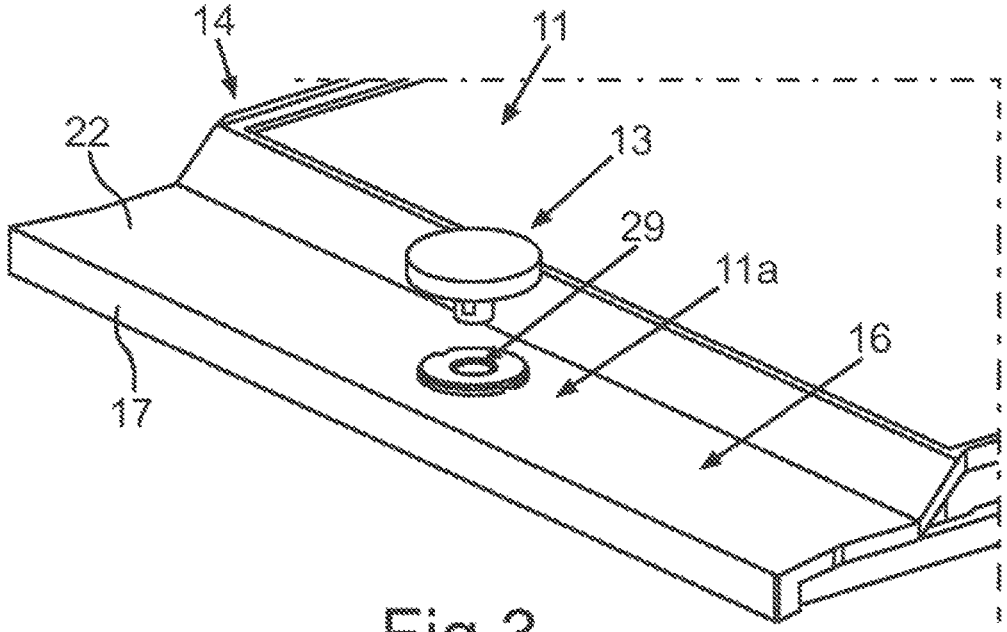
FIG. 3 shows a perspective view of the components in FIG. 2 with separate operating element.

FIG. 3 shows a further perspective view of an exemplary embodiment, in which the facing 20 is not present in contrast to the diagram in FIG. 2. The operating element 13 is also shown separate from the separating wall 11 and in particular the base part 14. The objects 25 to 27 are not configured in this embodiment either. As shown in FIG. 3, the operating element support 11*a* has a continuous hole 29 in its platform 16, extending through the operating element 13.

Figure 4:
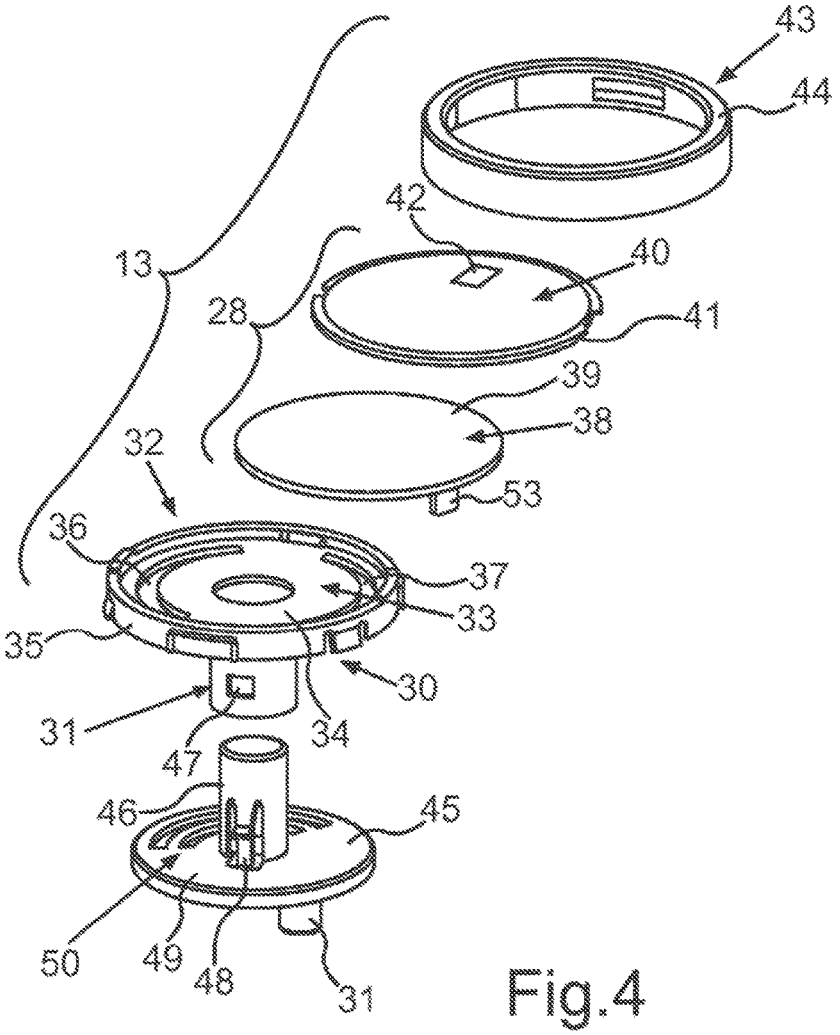
FIG. 4 shows an exploded view of an exemplary embodiment of an operating element with a display unit.

FIG. 4 shows an exploded view of an exemplary embodiment of the operating element 13. It comprises a display unit support 30, which is mushroom-shaped. This display unit support 30 comprises a stem 31 and a mushroom-shaped head 32. The plate-like mushroom-shaped head 32 has a depression 33 which comprises a base 34 and a peripheral web 35 or is formed and bounded by such. Configured in the base 34 are cutouts 36 and 37 running in an arc.

This arc-shaped cutouts 36 and 37 are also guide slots, through which components of the display unit 28 extend, thereby allowing relative movement between an element of the display unit 28 and the operating element 13.

In the exemplary embodiment the display unit 28 comprises an information disk 38 which has a number of information elements (not shown in detail) on an upper face 39. Preferably as many information elements as there are possible positions of the lid 9 are applied, in particular printed, in a fixed position and non-modifiably on the upper face 39.

The display unit 28 also comprises a cover plate 40, which can preferably be made of an at least translucent material, for example glass or plastic. The cover plate 40 is provided, in particular printed, with an opaque material on a lower face 41 facing the information disk 38, with at least one viewing window 42 being cut out, through which it is then always possible to see.

The operating element 13 also comprises a separate terminating ring 43, which is connected to the display unit support 30 in a rotationally fixed manner in the assembled state and completely encloses both the information disk 38 and the cover plate 40 in a peripheral manner about the axis A. A ring upper face 44 of the terminating ring 43 can extend horizontally in a plane or be configured as flat but be configured at an angle to the axis A.

FIG. 4 also shows a coupling element 45 of a coupling device. The operating element 13 is coupled to the lid 9 by way of this coupling device and therefore also the coupling element 45 and the movement of the lid 9 is then also brought about by way of said coupling device as a function of the rotation position of the operating element 13, the respectively desired position of the lid 9 being thereby set.

The coupling element 45 comprises a chimney-like shaft 46, which is connected to the stem 31, in particular by a non-destructively releasable connection, in particular by a latching connection, when connected to the operating element 13. To this end a latching cutout 47 is formed in the stem 31, in which a latching element 48 engages in the connected state.

The coupling element 45 also comprises a slotted disk 49, in which a guide slot 50 is configured. An eccentric pin 51 is also arranged on a lower face of the slotted disk 49.

Figure 5:
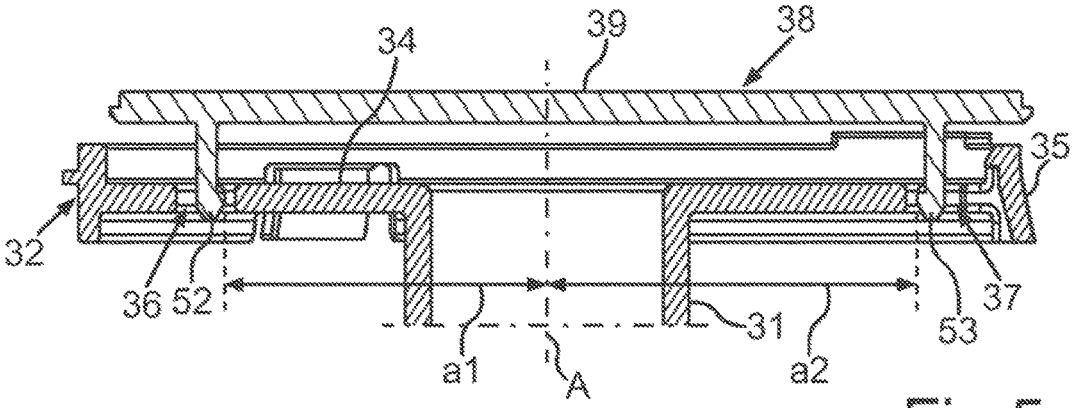
FIG. 5 shows a sectional view of the operating element according to FIG. 4 in the assembled state.

FIG. 5 shows a sectional view of the operating element 13 with the display unit 25, only showing the display unit support 30 and the information disk 38 and in the as yet unassembled end state. It can be seen that latching elements 52 and 53 arranged on the lower face of the information disk 38 facing away from the cover plate 40 engage through the cutouts 36 and 37. In the assembled end state the information disk 38 rests in particular on the base 34.

Provision is also preferably made for a gap al to be different from a gap a2, thereby establishing a certain assembly coding.

Figure 6:
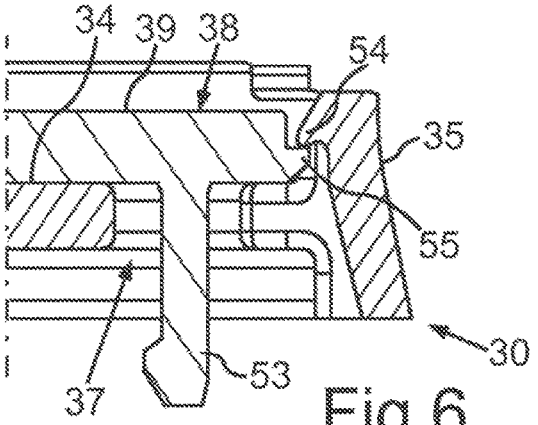
FIG. 6 shows a sectional view of the operating element according to FIG. 4 in the assembled state.

FIG. 6 shows an enlargement of a partial detail of the view in FIG. 5, with the information disk 38 already arranged in its end position in the depression 33 here. It can be seen that the web 35 has a lip 54, which rests on a recess 55 of the information disk 38, configuring a sort of snapping or latching here too, so that the information disk 38 is held in the axial direction. It should however be noted that there is relative movement between the display unit support 30 and the information disk 38 in the peripheral direction about the axis A when the operating element 13 is in the assembled end state with the display unit 28.

Figure 7:
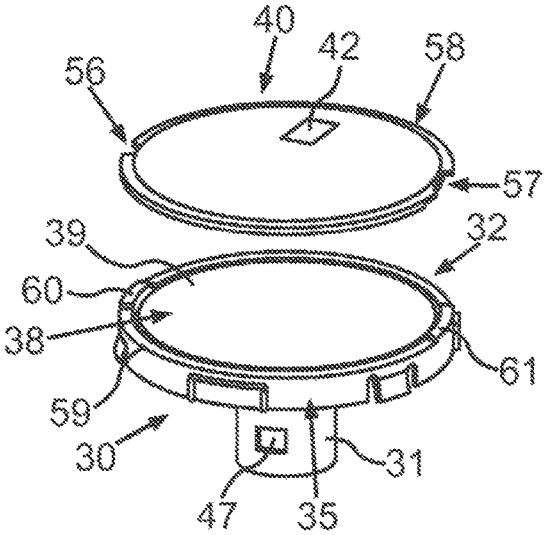
FIG. 7 shows a perspective view of subcomponents of the operating element according to FIG. 4.

FIG. 7 shows a perspective view of the display unit support 30 with the information disk 38 already assembled in the end position. The cover plate 40 is however not yet shown in its assembled end position.

As shown in FIG. 7, the cover plate 40 has cutouts 56 and 57, which are configured as open in a radially outward direction and therefore represent notches or indentations. These are configured in a flange-like peripheral web 58 of the cover plate 40. It can also be seen from FIG. 7 that elevations 60 and 61 are configured on an upper edge 59 of the web 35.

Figure 8:
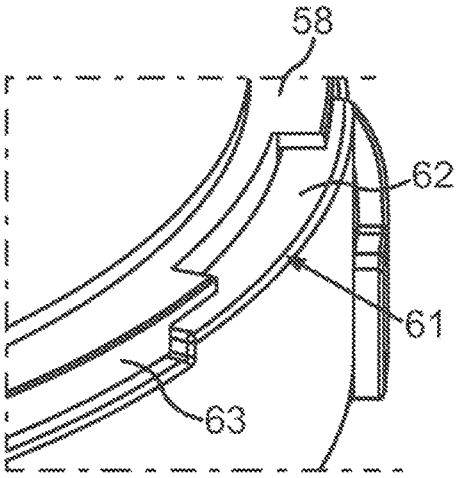
FIG. 8 shows an enlarged partial view of the components in FIG. 7 in the assembled state.

These are configured for coupling with the web 58 and also the cutouts 56 and 57, to generate a rotationally fixed coupling between the cover plate 40 and the display unit support 30. This is shown in the enlargement in FIG. 8. This shows a partial detail of the components in FIG. 7, with the cover plate 40 shown already in the assembled end state here. It can be seen that the web 58 engages over an upper face 62 of the elevation 61, the position of the cover plate 40 being fixed in the peripheral direction about the axis A in relation to the display unit support 30 by means of stops 63. The same is also brought about in respect of the mechanical coupling with the elevation 16 and the cutout 56. The elevations 60 and 61 are preferably of different lengths in the peripheral direction about the axis A and the stops 63 are preferably configured correspondingly so that the elevations 60 and 61 can be inserted with a close fit in the axial direction in these openings, which are bounded by the stops. The different lengths of the elevations 60 and 61 in the peripheral direction of the axis A in turn allow an assembly coding to be established for the cover plate 40.

Figure 9:
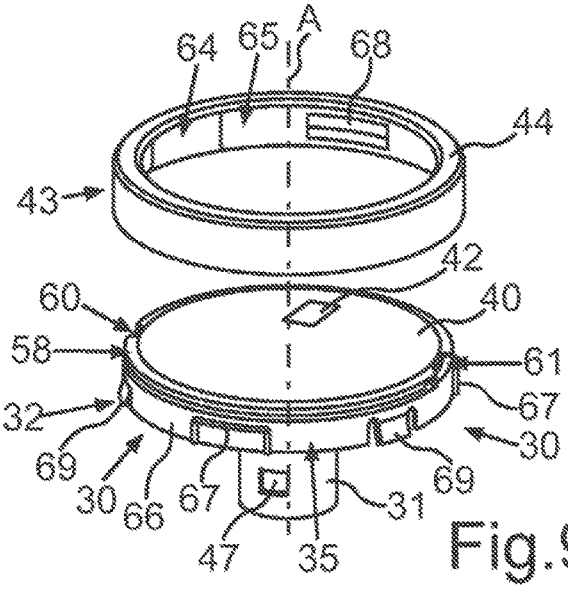
FIG. 9 shows a perspective view of the operating element with the terminating ring removed therefrom.

FIG. 9 shows a further exploded view of the operating element 13 with the display unit 28, the terminating ring 43 described above still being removed here.

The terminating ring 43 is positioned on the mushroom-shaped head 32 from above to move it into the assembled end position. Depressions 64 are configured on an inner face 65 of the terminating ring 43 for precise centering in the peripheral direction about the axis A. Corresponding engagement elements 67, which project radially outward, are also configured on an outer face 66 of the web 35.

Figure 10:
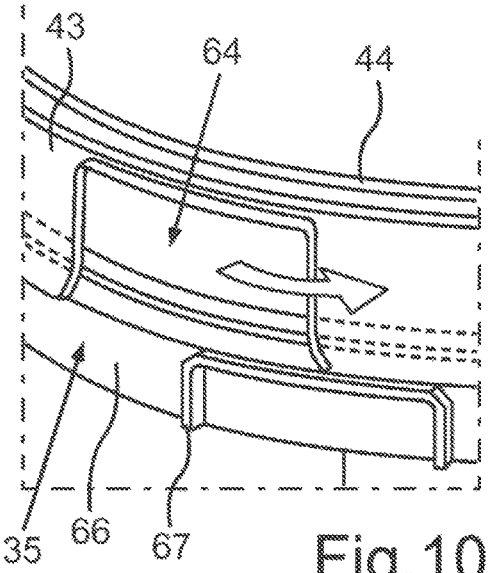
FIG. 10 shows a further enlarged view of the operating element according to FIG. 9 with the terminating ring already positioned on but not yet arranged in the end position.
Figure 11:
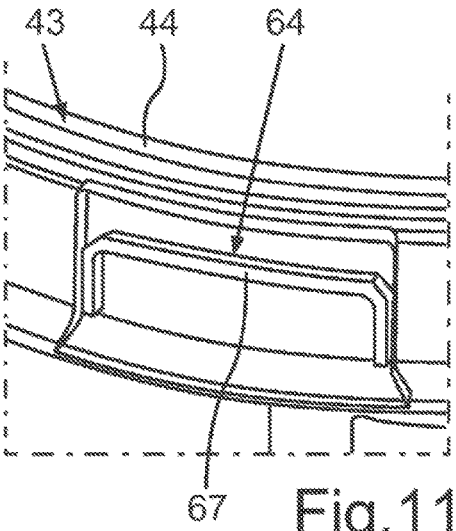
FIG. 11 shows a detailed view according to FIG. 10 with the terminating ring shown in the end position.

As shown in an enlargement in FIG. 10, when the terminating ring 43 is positioned on the mushroom-shaped head 32, the terminating ring 43 is rotated about the axis A relative to the mushroom-shaped head 32 until the engagement elements 37 enter the cutouts 64, as shown in FIG. 11.

As well as the abovementioned centering between the terminating ring 43 and the display unit support 30 about the peripheral axis A, there is also axial position fixing between said components. To this end at least one latching receiver 68, preferably a number of such latching receivers 68, is/are in turn configured on the inner wall or inner face 65. In the same way a number of latching elements 69 are preferably configured on the outer face 66 of the web 35.

Figure 12:
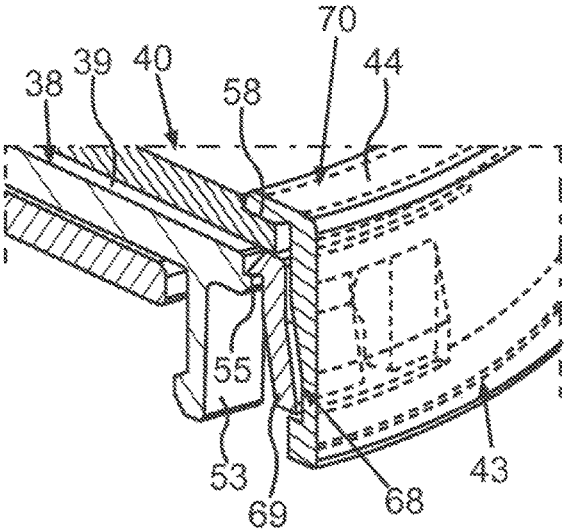
FIG. 12 shows a perspective sectional view of a subregion of the assembled operating element with the display unit.

As shown in the assembled end state between the terminating ring 43 and the display unit support 30 in FIG. 12, the latching elements 69 then engage in said latching receivers 68.

Figure 13:
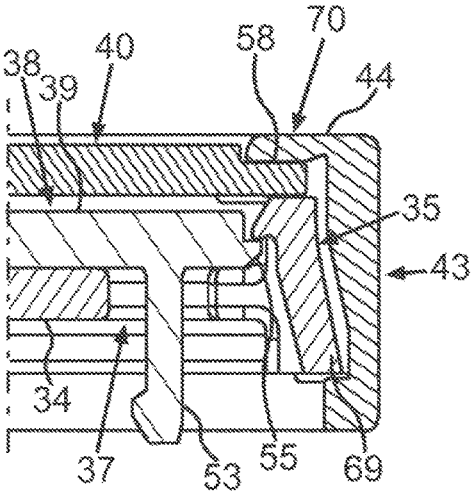
FIG. 13 shows a perspective sectional view of a subregion of the assembled operating element with the display unit.

As also shown in FIG. 12, a radial flange 70 of the terminating ring 43 with the upper face 44 overlaps the cover plate 40 in the radial direction, in particular in the region of the web 58 there. As already shown in FIGS. 7 to 9, said web 58 is offset in a staged manner downward in the axial direction in relation to the further surface of the cover plate 40, thereby forming a corresponding bearing platform, on which said radial flange 70 then rests from above, as shown in FIG. 12 and FIG. 13. The corresponding mechanical coupling and latching connection between the terminating ring 43 and the display unit support 30 mean that the position of the cover plate 40 is also fixed axially.

FIG. 13 shows the sectional view corresponding to FIG. 12.

Figure 14:
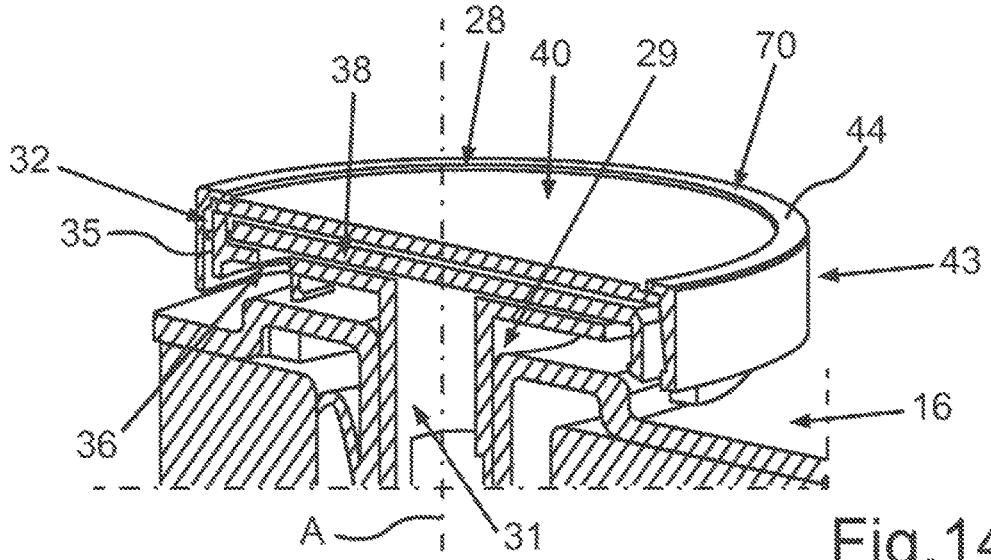
FIG. 14 shows a perspective section of the view in FIG. 2 in the region of the operating element.

FIG. 14 shows a perspective sectional view of the assembled end state of the operating element 13 in the operating element support 11*a*, a sectional view along the section line XIV-XIV from FIG. 2 being shown here.

Figure 15:
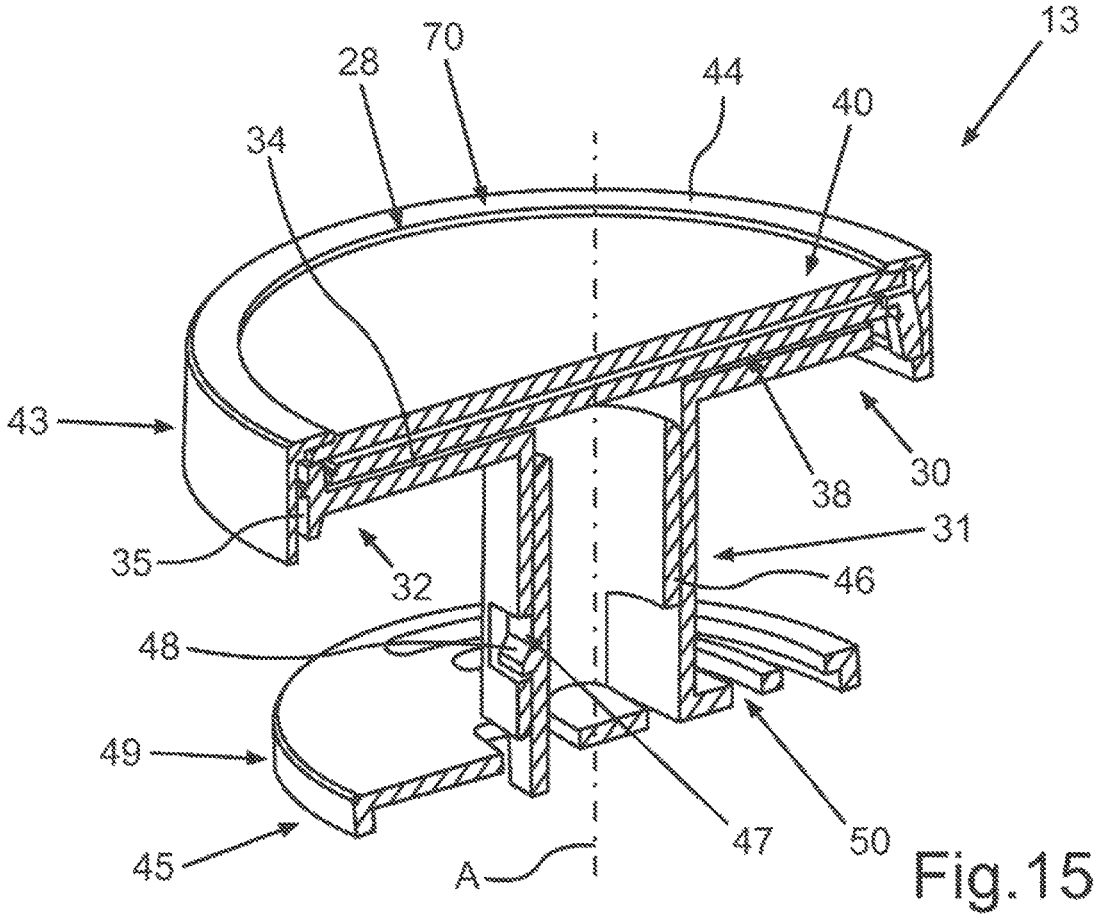
FIG. 15 shows a further perspective sectional view of the operating element in the coupled state with an element of a coupling device.

FIG. 15 shows a perspective sectional view of the operating element 13 with the display unit 28 in the coupled end state with the coupling element 45.

Figures 16, 17, 18:
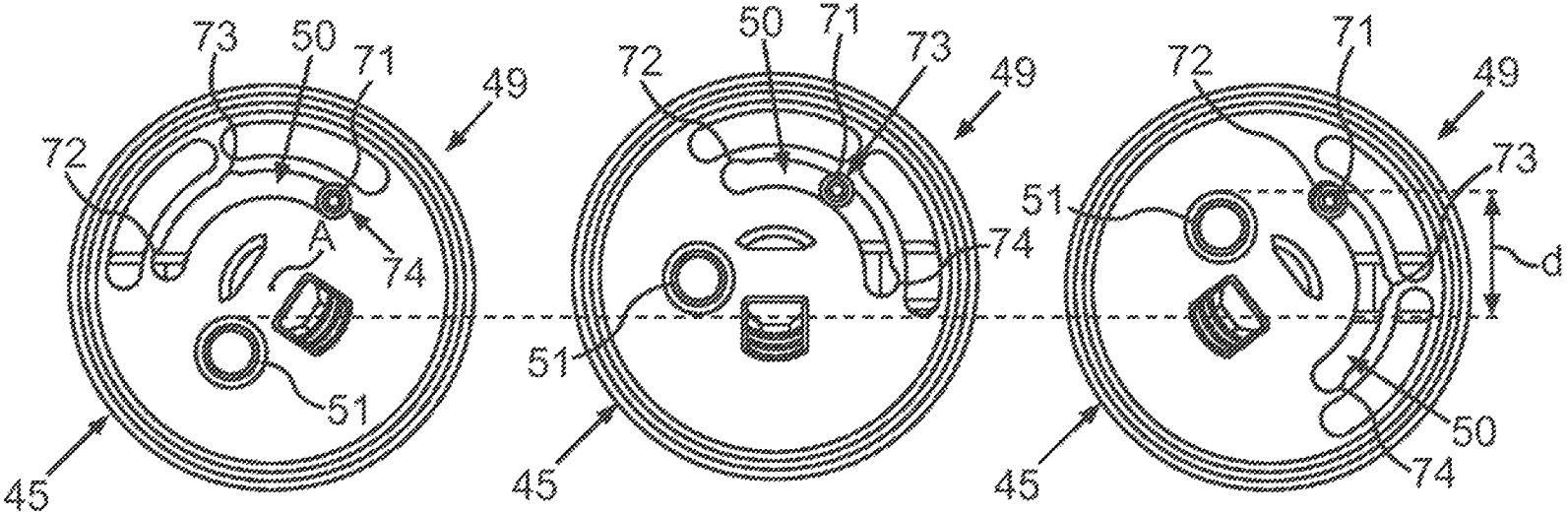
FIG. 16 shows a plan view of sub-elements of the coupling device with a position, in which the lid is arranged in a first end position.
FIG. 17 shows a plan view according to FIG. 16, in which the lid is arranged in an intermediate position.
FIG. 18 shows a plan view according to FIG. 16 and FIG. 17, in which the lid is arranged in a further end position.

FIG. 16 shows a view from below of the coupling element 45 and therefore the face of the slotted disk 49 facing away from the operating element 13. The curved guide slot 50 is clearly visible. A guide block 71 engages therein. It can be seen that in the exemplary embodiment three notches 72, 73 and 74 are configured on the radially outer boundary edge of the guide slot 50. These represent lockable positions of the lid 9, which are then correspondingly maintained. The guide block 71 snaps into said notches 72 to 74 as it moves about the axis A, and the respectively reached position of the lid 9 is thereby maintained. The two notches 72 and 74 then represent a closed and open end position of the lid 9, while an intermediate position of the lid 9 is maintained by the notch 73.

Figure 19:
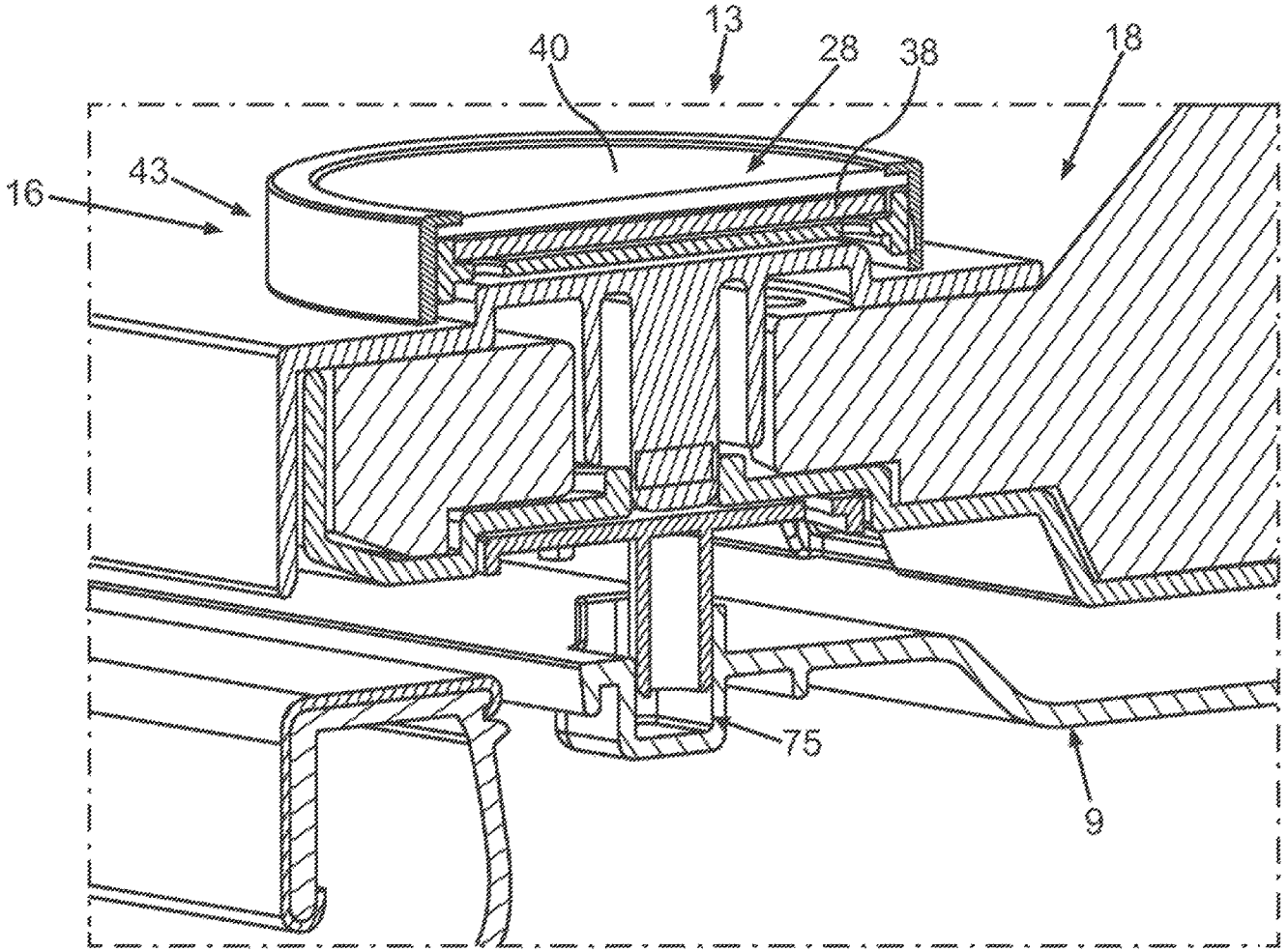
FIG. 19 shows a further section of the view in FIG. 2.

The eccentric element 51 is also visible here. According to the perspective sectional view in FIG. 19, which shows a sectional view along the section line XIX-XIX from FIG. 2, this engages in an engagement region 75 in the lid 9. The eccentric arrangement in relation to the axis A means that a rotation movement of the operating element 13 about the axis A causes the lid 9 to perform a certain movement, sliding along the guide paths due to the action of said force, so that the lid 9 is raised from the drawer 15 due to the orientation of the guide paths and reaches the intermediate position or the completely open position or on the other hand rests on the drawer 15, so that the closed position of the lid 9 is reached.

The intermediate position is reached in FIG. 17, as the guide block 71 is held in the notch 73. In the same way, the second end position is shown in FIG. 18, as the guide block 71 is arranged in the notch 72 and has reached the other end of the guide slot 50. A distance d shown between FIGS. 16 to 18 also shows the displacement movement of the eccentric element 51, it being possible for d to be 18 mm for example.

Figure 20:
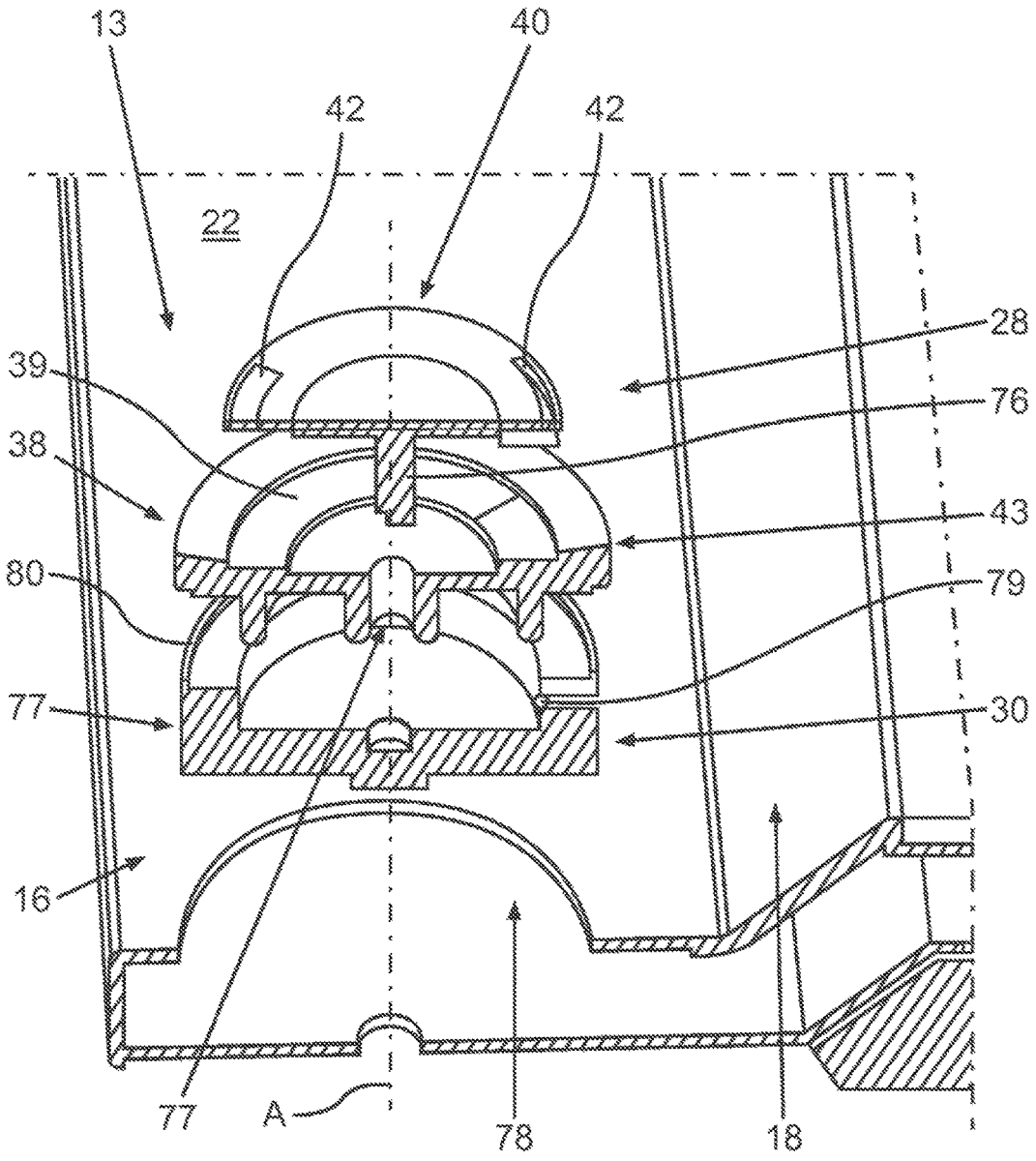
FIG. 20 shows a further perspective sectional view of a further exemplary embodiment of an operating element with a display unit and an operating element support, in which the components are shown in an exploded view.

FIG. 20 shows a perspective sectional view in the manner of an exploded diagram of a further exemplary embodiment. In contrast to the diagram of the previous exemplary embodiment, provision is made here for the cover plate 40 to have a centrally arranged pin 76, which engages here through a hole 77 in the information disk 38. In this embodiment provision is made for an operating element socket 77 of the operating element 13 to be arranged on the base part 14. It is arranged so that it is sunk into an opening 78 here. In contrast in this exemplary embodiment the information disk 38 is coupled in a rotationally fixed manner to the terminating ring 43 and can be rotated in the peripheral direction about the axis A relative to the operating element socket 77. As the cover plate 40 is in turn coupled in a rotationally fixed manner to the operating element socket 77, there is also relative movement about the axis A between the terminating ring 40 and the information disk 38 in relation to the cover plate 40. The cover plate 40 can have one viewing window 42 or a number of viewing windows 42. The linear viewing windows 42 can in turn be configured in such a manner in the peripheral direction of the axis A that they appear at different segments in the peripheral direction about the axis A as a function of the rotation position of the operating element 13 in assigned positions of the lid 9 or information elements on the upper face 39 can be identified transparently through said narrow linear viewing windows 42 and run adjacent to optical connecting lines to the objects 25 and 27 applied to the face 22, as described in the example in FIG. 2. Respectively assigned symbols and/or letters in the radially wider viewing windows 42, as shown in FIG. 20, can then indicate the food which can preferably be stored in the drawer 8 when the lid 9 is in this position.

The information disk 38 can for example be mounted with the terminating ring 43 by way of a catch 79, in particular a radial catch, in the operating element socket 77, allowing it to be rotated relative thereto in the peripheral direction about the axis A.

In the assembled state an upper face of a peripheral web 80 of the operating element socket 77 is preferably arranged flush with the face 22. The terminating ring 43 preferably rests on the web 80.

LIST OF REFERENCE CHARACTERS

1 Domestic refrigeration appliance
2 Carcass
3 Internal container
3*a* Vertical side wall
3*b* Vertical side wall
4 Chiller compartment
5 Freezer compartment
6 Door
7 Freezer compartment door
8 Food storage container
9 Lid
10 Cover
11 Separating wall
11*a* Operating element support
12 Mounting device
13 Operating element
14 Base part
15 Drawer
16 Platform
17 Front edge
18 Surface region
19 Upper face
20 Facing
21 Upper face
22 Upper face
23 Front face
24 Display region
25 Object
26 Object
27 Object
28 Display unit
29 Hole
30 Display unit support
31 Stem

32 Mushroom-shaped head
33 Depression
34 Base
35 Web
36 Cutout
37 Cutout
38 Information disk
39 Upper face
40 Cover plate
41 Lower face
42 Viewing window
43 Terminating ring
44 Ring upper face
45 Coupling element
46 Shaft
47 Latching cutout
48 Latching element
49 Slotted disk
50 Guide slot
51 Eccentric pin
52 Latching element
53 Latching element
54 Lip
55 Recess
56 Cutout
57 Cutout
58 Peripheral web
59 Upper edge
60 Elevation
61 Elevation
62 Upper face
63 Stops
64 Depressions
65 Inner face
66 Outer face
67 Engagement elements
68 Latching receiver
69 Latching elements
70 Radial flange
71 Guide block
72 Notch
73 Notch
74 Notch
75 Engagement region
76 Pin
77 Operating element socket
78 Opening
79 Catch
80 Peripheral webs
D Distance
A Axis
a1 Gap
a2 Gap

The invention claimed is:

1. A domestic refrigeration appliance, comprising:

an internal container having walls defining an internal compartment for holding food and said internal compartment being bounded by said walls;

a lid;

a food storage container for the food, being disposed in said internal compartment and can be closed by said lid;

a mounting device mounting said lid in said internal compartment such that said lid can be raised and lowered to open and close said food storage container;

an operating element for actuating said lid, wherein it is possible for said operating element to be actuated on an actuation path to actuate said lid and for said lid to be positioned in a first closed position and at least in a second completely open position in dependence on a position of said operating element, said operating element having a display unit to display symbolic information in dependence on a position of said lid;

said display unit having an information disk with information elements configured in a fixed position and permanently thereon; and an operating element support, said information disk disposed in said operating element and fastened in a fixed position on said operating element support, on which said operating element is disposed such that said operating element can be moved relative to said operating element support.

2. The domestic refrigeration appliance according to claim 1, wherein said display unit is a non-electronic display unit.

3. The domestic refrigeration appliance according to claim 1, wherein the information element is configured as a printing.

4. The domestic refrigeration appliance according to claim 1, wherein said information disk is disposed in a latched manner on said operating element support.

5. The domestic refrigeration appliance according to the claim 1, wherein said display unit has a cover plate disposed in said operating element and covering said information disk from above.

6. The domestic refrigeration appliance according to claim 5, wherein said cover plate is disposed on said operating element in a fixed position in such a manner that said cover plate can be moved relative to said information disk, namely by means of a non-destructively releasable connection.

7. The domestic refrigeration appliance according to claim 5, wherein said cover plate has at least one viewing window, through which the information element configured on an upper face of said information disk facing said cover plate can be identified in dependence on the position of said operating element and therefore a position of said cover plate relative to said information disk.

8. The domestic refrigeration appliance according to claim 7, wherein said cover plate is configured from an at least translucent material and has a lower face facing said information disk, apart from said viewing window, being formed from an opaque material.

9. The domestic refrigeration appliance according to claim 5, wherein said operating element has a mushroom-shaped display unit support for said display unit, wherein said mushroom-shaped display unit support is disposed on said operating element support so that said mushroom-shaped display unit support can be moved relative thereto, wherein said information disk and said cover plate of said display unit are disposed in a mushroom-shaped head of said mushroom-shaped display unit support.

10. The domestic refrigeration appliance according to claim 9, wherein said operating element has a terminating ring, said terminating ring is connected in a rotationally fixed manner to said mushroom-shaped display unit support and which encloses said mushroom-shaped head and said cover plate peripherally.

11. The domestic refrigeration appliance according to claim 10, wherein said terminating ring has a cone-shaped upper face.

12. The domestic refrigeration appliance according to claim 9, wherein:

said operating element support has an opening formed therein;

said operating element has a coupling device; and said mushroom-shaped display unit support has a stem that extends through said opening in said operating element support and is connected to said coupling device to move said lid.

13. The domestic refrigeration appliance according to claim 1, wherein said operating element support has a surface region which is oriented obliquely upward, on which information about a moisture content in said food storage container in dependence on the position of said lid is displayed in a fixed position and information elements relating to food to be preferably stored in said food storage container with a respective lid position are configured on said display unit of said operating element.

14. The domestic refrigeration appliance according to claim 1, wherein:

said operating element having an operating element socket; and said operating element has a terminating ring and said information disk is connected to said terminating ring in a rotationally fixed manner and accommodated in said operating element socket configured as a display unit support and disposed in a fixed position in said operating element support.

15. A domestic refrigeration appliance, comprising:

an internal container having walls defining an internal compartment for holding food and said internal compartment being bounded by said walls;

a lid;

a food storage container for the food, being disposed in said internal compartment and can be closed by said lid;

a mounting device mounting said lid in said internal compartment such that said lid can be raised and lowered to open and close said food storage container;

an operating element for actuating said lid, wherein it is possible for said operating element to be actuated on an actuation path to actuate said lid and for said lid to be positioned in a first closed position and at least in a second completely open position in dependence on a position of said operating element, said operating element having a display unit to display symbolic information in dependence on a position of said lid;

said display unit having an information disk with information elements configured in a fixed position and permanently thereon;

an operating element support;

said operating element having an operating element socket; and said display unit having a cover plate covering said information disk and said cover plate is connected in a rotationally fixed manner to said operating element socket configured as a display unit support and disposed in a fixed position in said operating element support.

* * * * *